US006482066B1

(12) United States Patent
Kelly

(10) Patent No.: US 6,482,066 B1
(45) Date of Patent: Nov. 19, 2002

(54) MOBILE MOBILES

(76) Inventor: Bretta Kelly, 1730 E. Park Ave., Chandler, AZ (US) 85225

( * ) Notice: Subject to any disclaimer, the term of this patent is extended or adjusted under 35 U.S.C. 154(b) by 0 days.

(21) Appl. No.: 09/813,844

(22) Filed: Mar. 22, 2001

Related U.S. Application Data

(60) Provisional application No. 60/191,546, filed on Mar. 23, 2000.

(51) Int. Cl.[7] ..... A63H 33/00

(52) U.S. Cl. ..... 446/227; 248/214; 40/617

(58) Field of Search ..... 248/104, 105, 248/214, 205.1; 40/455, 456, 473, 493, 617; 446/227

(56) References Cited

U.S. PATENT DOCUMENTS

| | | | | |
|---|---|---|---|---|
| 3,014,307 A | | 12/1961 | Bupuis | 46/1 |
| 4,147,344 A | * | 4/1979 | Lee | 273/331 |
| 4,188,745 A | | 2/1980 | Harvey et al. | 46/32 |
| 4,627,588 A | | 12/1986 | Block | 248/163.2 |
| 4,756,109 A | * | 7/1988 | Marcus | 40/455 |
| 5,370,570 A | | 12/1994 | Harris | 446/227 |
| 5,951,360 A | | 9/1999 | Fearon et al. | 446/227 |

* cited by examiner

*Primary Examiner*—Jacob K. Ackun
(74) *Attorney, Agent, or Firm*—Patent & Trademark Services; Thomas Zack; Joseph H. McGlynn

(57) ABSTRACT

This invention relates to a free standing vertical support having a support used to attach an infant's toy such as a mobile.

3 Claims, 7 Drawing Sheets

17
16
18
13

25
13
16
A
11
9
7
11
3
15
17
23
19
21
23
1
23
19

MOBILE MOBILES

This invention claims the benefit of the U.S. Provisional application No. 60/191,546 filed on Mar. 23, 2000.

BACKGROUND OF THE INVENTION

The present invention relates to a movable mobile stand with a supporting base and an adjustable height support.

Infant's mobile toys have long been attached to cribs to provide amusement to the observer and assist the infant in developing eye ordination. Many of these infant suspended mobiles are attached by supporting arms, frames and the like to the existing infant's crib. This type of arrangement limits the field of use of the mobile to specific structure to which the mobile can be attached (e.g., the crib). Providing for a greater latitude in use would be very desirable especially if the mobiles could be used anywhere the infant is likely to rest or be placed, such as on a blanket on the floor, a crib, playpen, a highchair, etc.

DESCRIPTION OF THE PRIOR ART

Infant toys, especially mobiles, have been constructed in a vary of ways and some have been attached to cribs, highchairs and the like by supporting mobile structures to permit movable objects to be suspended over the head of the infant. For example, in the U.S. Pat. No. 3,014,307 to Dupuis the toys are attached to a highchair and has an adjustable vertical section and a horizontal section on which the toys are attached.

U.S. Pat. No. 4,188,745 to Harvey et al. discloses hanging toys that may be attached to an infant's seat, car seat or the like. Included in this invention is a stand with a U-shaped support having toys attached to the horizontal portion of the support.

U.S. Pat. No. 4,627,588 to Block discloses a structure with suspended toys that uses a support structure for the suspension above the baby's carry seat.

U.S. Pat. No. 5,370,570 to Harris discloses an adjustable support for attaching mobiles to a crib.

U.S. Pat. No. 5,951,360 to Fearon et al. discloses a support for attaching mobiles to a crib in which the support arm is attached to a revolving base.

In the present invention a free standing and portable single adjustable vertical section with a box-like support is used to attach a mobile or any toy that is created to attach to a crib all as will be detailed in the specification that follows hereafter.

SUMMARY OF THE INVENTION

This invention relates to a free standing vertical support having a support used to attach an infant's toy such as a mobile.

It is the primary object of the present invention to provide for an improved free standing portable support structure for use with an infant's mobile or any other crib attached toy.

Another object is to provide for such a structure in which there are two vertical rods extending from a weighted base to attach crib toys including mobiles to the stand.

These and other objects and advantages of the present invention will become apparent to readers from a consideration of the ensuing description and the accompanying drawings.

DESCRIPTION OF THE PREFERRED EMBODIMENT

Figure 1:
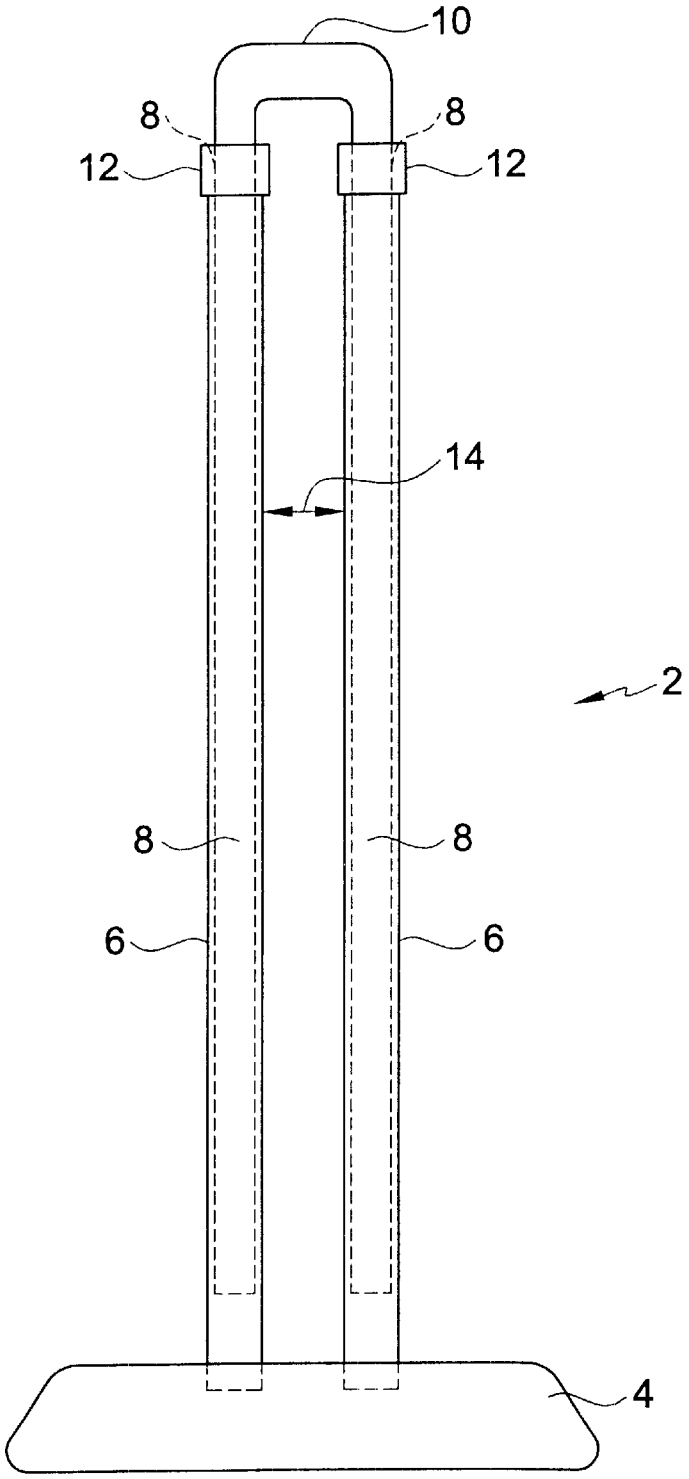
FIG. 1 is a front view of a first preferred embodiment for the stand.

FIG. 1 is a front view of a first preferred embodiment for the stand 2. A lower base 4 has a dome shaped upper surface. This dome shape insures that a baby will not get hurt if he or she rolls into the base. The base is made sturdy so that it will not topple over. One way to make the base sturdy is to weigh it down. This can be accomplished by making the base 4 hollow and to add a filling material, like water or sand, to the hollow interior of the base. Appropriate openings that are both openable and closable to add the fill material should be provided for in the base.

The two parallel poles 6 about one inch in diameter each have their lower ends embedded in holes in the base 4. The poles 6 have hollow interiors which permit two inner poles 8, shown in dotted line format, to telescopingly fit within them. Each pole 6 and 8 is about two feet long. At the tops of the inner poles 8 is a handle 10 that joins them together in a U-shaped configuration.

An adjustable outer collar 12 is located at the top of each of the outer poles 6 may bear against their inner pole surface to lock them in a vertical position with respect to the outer poles. Collar 12 is an internally threaded conventional turn able collar than engages threads on the upper end of lower support poles 6 and is capable of slightly constricting the hole support's size when turned on the threaded connections. This conventional collar 12 allows some or most of the two inner poles to be extended above the two outer poles, a maximum distance of about two feet, by pulling on handle 10 upwardly. Once in place the inner and outer poles are locked in position and then turning the collars 12 to a tightened position at the desired height.

The space defined by the distance 14 between the two parallel poles 6 can be used to attach mobiles or other toys at the desired height relative to a baby's environment.

Figure 2:
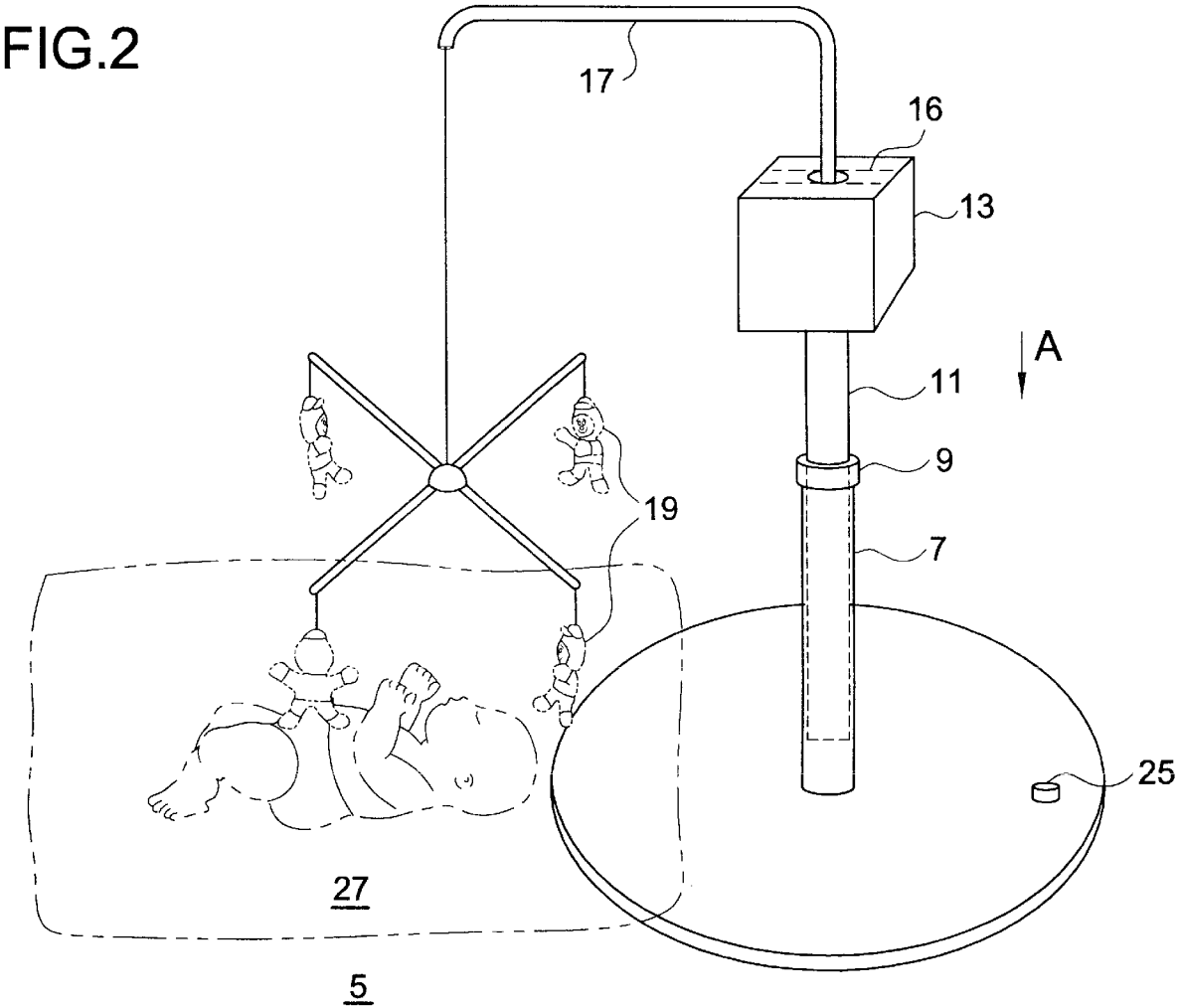
FIG. 2 is a side perspective view of another embodiment of the present invention with the mobiles in a more lowered position when placed next to and over an infant's blanket on the floor.

FIG. 2 is a side perspective view of another embodiment of the present invention with the mobiles in a more lowered position when placed next to and over an infant's blanket 27, shown in dotted line format,on the floor 5. This view is essentially the same as FIG. 6, except that the crib has been replaced by the blanket 27 and the upper tubular support member 11 has been lowered relative to the floor in the direction of arrow A within the confines of the lower support 7.

Normally, it is anticipated the vertical adjustment of upper support 11 relative to the lower support 7 can vary by up to five feet. In each case this is accomplished by loosening the support retaining collar 9 and then moving the upper tubular support 11 to the desired vertical elevation after which the collar is re tightened in place. In this second figure, since the blanket is considerably closer to the fixed floor 5 than the crib 1, the box 13 with its simulated attachment crib rail 16 is several feet lower than in the first embodiment.

Figure 3:
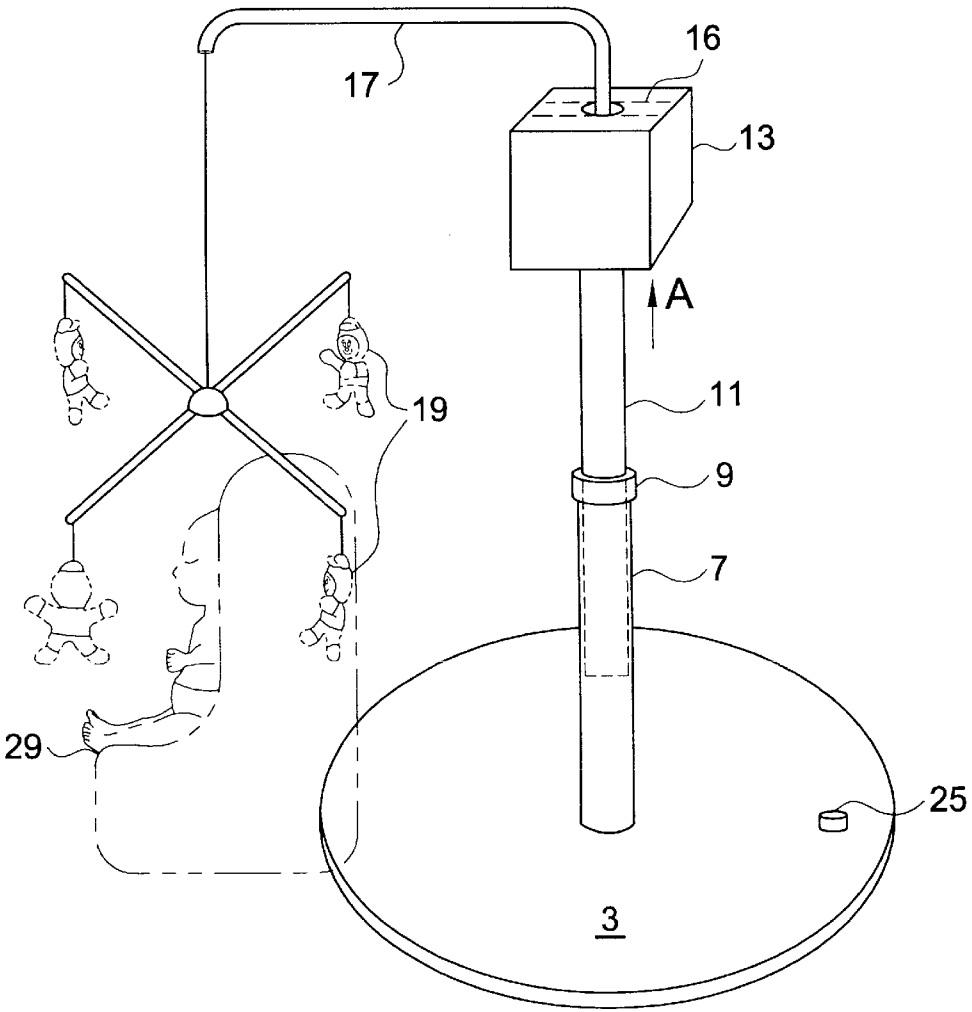
FIG. 3 is a side perspective view of the FIG. 2 embodiment with the mobiles in an elevated position when placed next to and over an infant's chair.

FIG. 3 is a side perspective view of the FIG. 2 embodiment with the mobiles in an elevated position when placed next to and over an infant's chair 29, shown in dotted line format. The upper support 11 has been moved upwardly relative to the lower support 7 and then fixed in position by tightening the retaining collar 9. In the FIGS. 2, 3 and 6, the conventional mobiles are over the head of the infant and fixed in place by tightening the collar 9.

Figure 4:
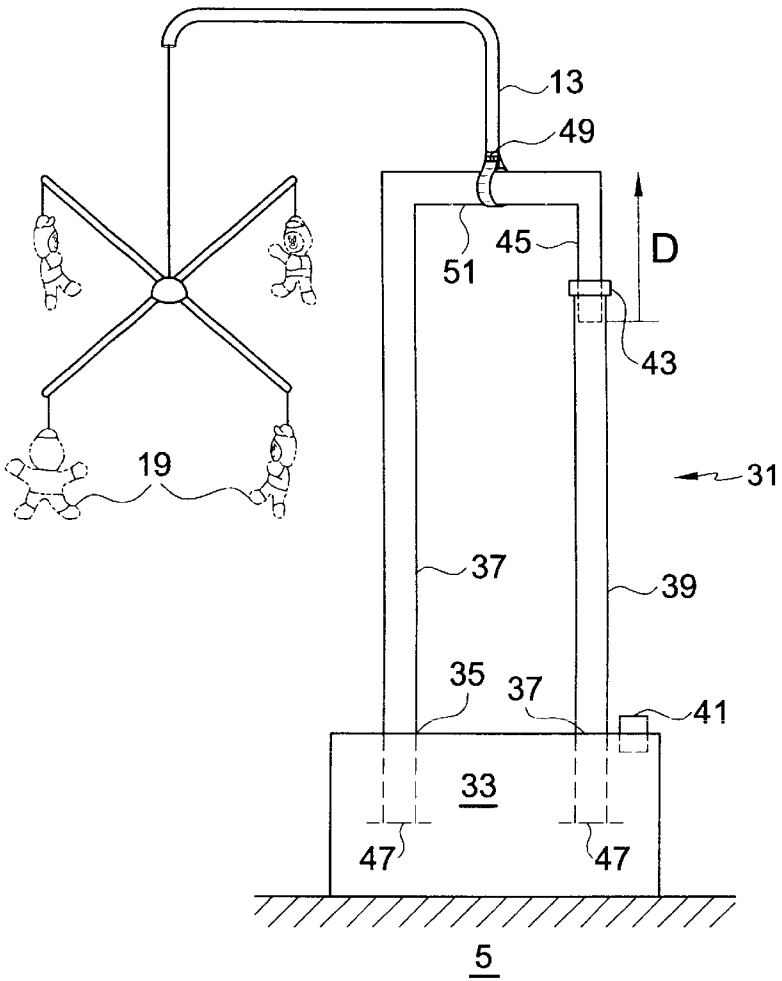
FIG. 4 is a cross section of the front view of a still another embodiment of the invention showing an adjustable U-shaped mobile support structure.

FIG. 4 is a cross section of the front view of a still another embodiment of the invention showing an adjustable U-shaped mobile support structure 31. The hollow base has two spaced holes 35 and 37 that extend through the base's top surface. One of the lower ends leg 37 fits into the hole 35 while the lower end of leg 39 also of structure 31 fits into the other base hole 37. To give the base weight and prevent it from moving or tipping over, a third hole 41 that has a removable cap allows a filler material (water,sand, etc.) to be placed within the base's interior. The upper end of leg 39 is hollow and opened. This permits the engaging vertical end of leg 37 to fit telescoping style into opened end of leg 39. A retaining conventional threaded collar 43 fixes the vertical disposition of the two legs relative to each other.

Normally, the legs may be vertically adjusted a distance D as shown. This distance is limited by the length of the right hand segment 45 of leg 37 that engages the other leg 39. It should be clear that the lower ends of both legs 37 and 39 are slidably mounted in the holes in base 33 and that the filler material is added to the base only after the proper desired relationship between the legs has been achieved.

Appropriate stops 47, shown in dotted line format, fixed to the interior walls of base 33 may extend from the wall to engage the lower ends of the legs to prevent them from contacting the bottom of the base's bottom. A conventional mobile 13 like that shown in the first figure may have lower end clamp 49 to permit the attachment to the horizontally disposed section 51 of leg 37. By tightening retaining collar 43 the two legs are fixed relative to each other.

Figure 5:
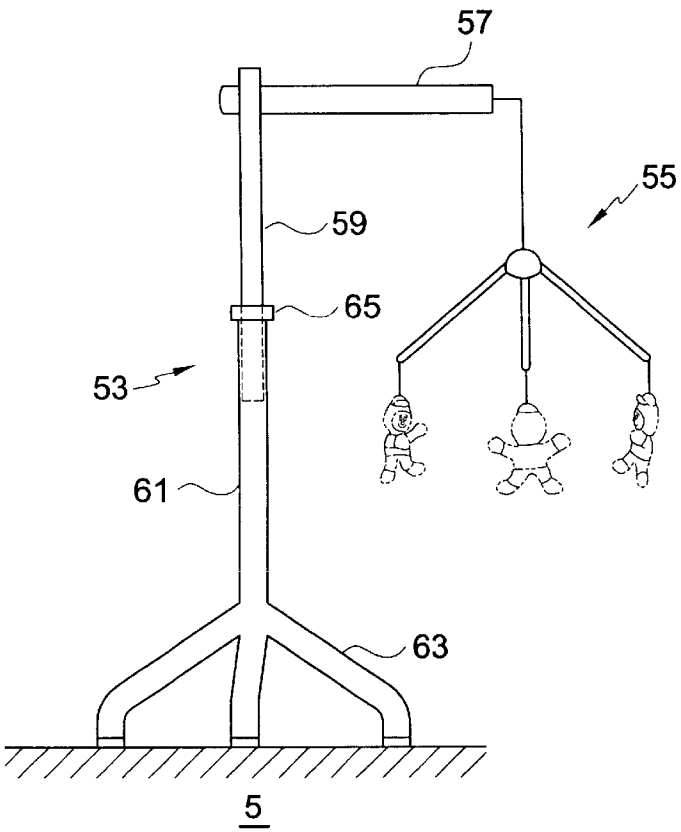
FIG. 5 is a side view of another embodiment of the invention showing a vertical adjustable support structure for the vertically suspended elevated mobile.

FIG. 5 is a side view of still another embodiment of the invention showing an L-shaped vertical adjustable support structure 53 for the vertically suspended elevated mobile 55. In this embodiment the mobile hangs from the horizontally disposed arm 57 of support structure 53 and is therefore different from the mobile supports in the previously described figures. The vertical members of support structure 53 consist of a tubular upper support 59, a larger diameter lower support 61 and three conventional tripod like pedestal spaced feet 63 which engage the floor 5. The diameter of upper support 59 is less than the diameter of the upper hole in lower support 61 and is telescopically received. To fix the vertical height of horizontal mobile supporting arm 57 above the floor, a retaining threaded conventional collar clamp 65 is used. By tightening collar 65 the hole in support 61 is restricted in diameter fixing the upper support 59 in place relative to the lower support. Appropriate fasteners or welds, etc. are also needed where the arm 57 joins the tether for the mobile 35 and where it joins with the vertical upper part of member 59.

Figures 6A, 6B:
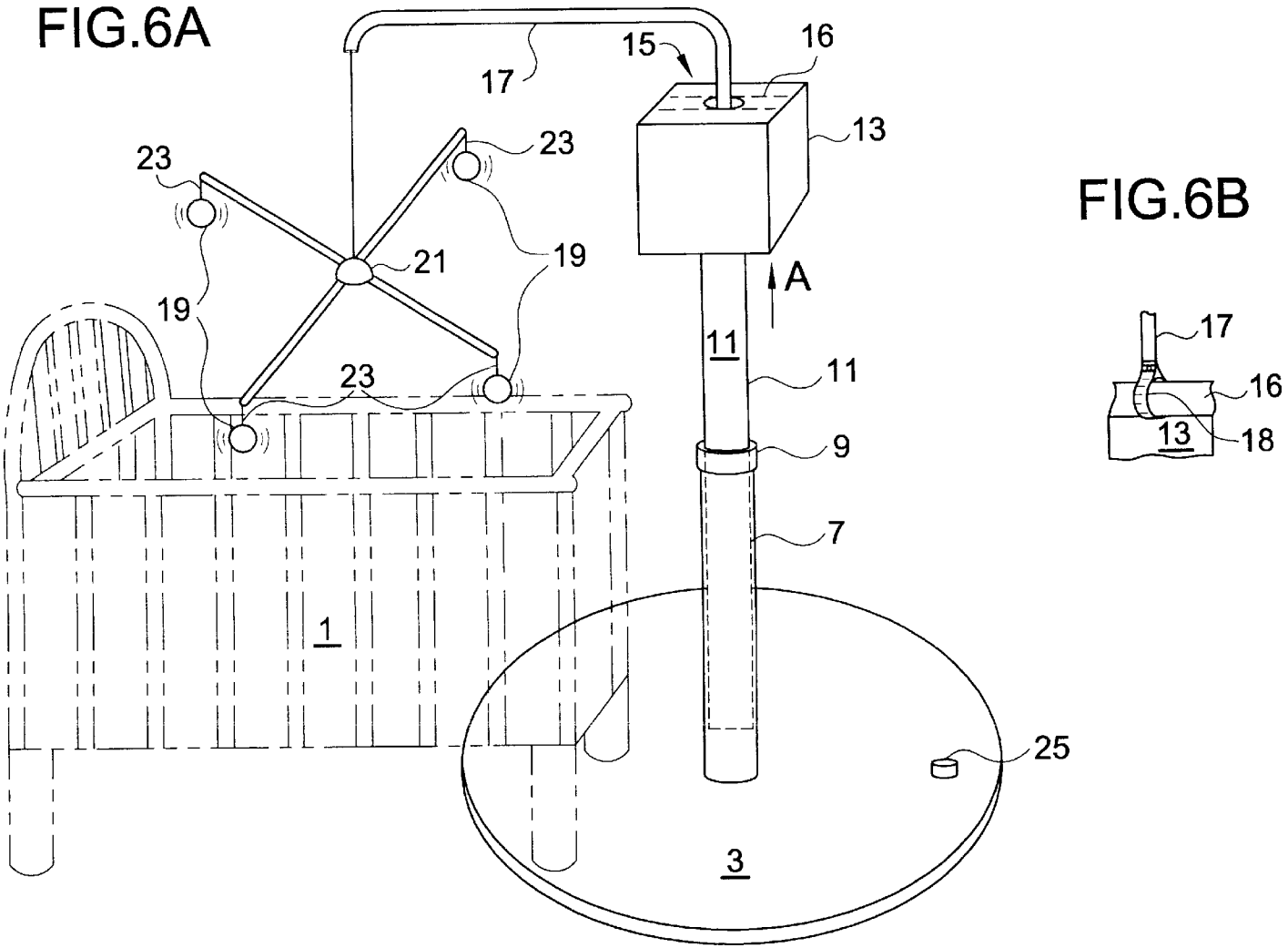
FIG. 6 is a side perspective view of another second preferred embodiment of the present invention placed next to and over an infant's crib or playpen.

FIG. 6 is a side perspective view of one of the preferred embodiments of the present invention placed next to and over an infant's crib 1, shown in dotted line format. A relatively large base 3 with a flat bottom is placed upon the floor 5 of a room. Extending upwardly from the base 3 at approximately the base's center is an attached vertical hollow interior lower support 7. A short distance up the support 7 is an adjustable outer collar 9. Collar 9 is an internally threaded conventional collar than engages threads on the upper end of lower support 7 and is capable of slightly constricting the hole support's size when turned on the threaded connections. Inserted within the hollow interior of vertical support 7 is the upper telescopically received vertical upper support 11. The outer diameter of upper support 11 is slightly less than the diameter of the hole running the height of the tubular shaped lower support 7.

By tightening the threaded collar 9 the upper and lower supports 7 and 11 may be fixed in place relative to each other and the lower base 3. This permits the vertical adjustment of the upper support 11 in either of the directions shown by the arrows A. Further up on the top of upper support 11 is the attached box-like structure 13. Structure 13 is specifically constructed so that it may receive and hold standard bases of conventional mobiles that are commercially available. For example, if the lower supporting structure of the conventional mobile would normally be attached with a clamp to the rail of a baby's crib, then the top surface 15 would have a rail like section 16 which resembles part of a baby's crib rail in size and structure. This allows the conventional mobile U-shaped support 17 to be attached by its own lower hold down clamp 18 to the member 13 as shown in the circle to the right of FIG. 6.

Of course, any type of supplied conventional holding clamp 18 may be used for the purpose of retaining the simulate crib rail 16 to the engaged vertical member of support 17 Once attached, the other free ends of the support 17 contain conventional mobile figures 19. Each of the figures may the same or each can be completely different from the other. Additionally the figures 19 may be moved by a battery operate motor to permit their rotation very slowly around the center joint 21 where connected to the support 17 or each mobile may rotate on its own individual vertical supports 23.

The lower base support 3 fixed to the lower vertical support 7 can be hollow to permit its easy portability and movement to convenient locations. To weight down the base 3 after it has been moved to the desired location, a small capped hole 25 permitting access to the hollow interior of the base may be used. Water, sand or any other safe and flow able heavy material may be inserted into the confines of the base to weigh it down. When one desires to move the base and its attached upper members, the cap on hole 25 is removed and its contents emptied.

Figure 7:
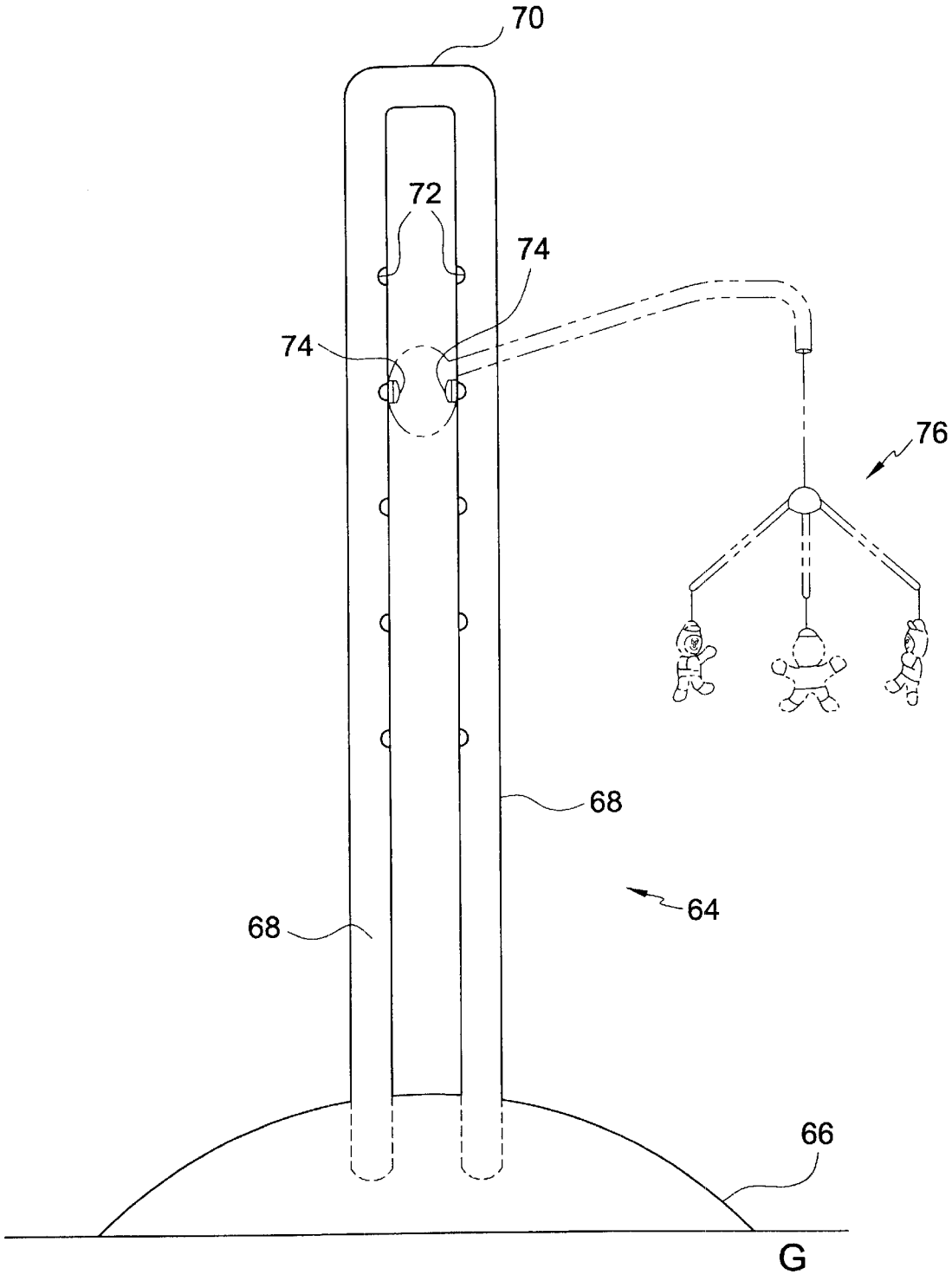
FIG. 7 is a side view of another third preferred embodiment for the stand.

FIG. 7 is a side view of another preferred embodiment design for the stand. A single U-shaped pole member 64 has its lower ends fixedly mounted in the dome shaped base 66. As in FIG. 1 design the dome shaped base may be made hollow and weighed down by added fill material. Joining the two parallel poles 68 at their top ends is a U-shaped jointing member 70. Unlike the FIG. 1 embodiment, there are no telescoping inner pole members in the FIG. 7 embodiment. Extending along the inner surfaces of each pole 68 are a series of spaced holes 72. These holes face each other and act as receptors for one or more stoppers 74. Connect to the stoppers 74 are one or more depending toy mobiles 76 that extend outwardly from the poles. The stoppers and mobile are all shown in dotted line format. By changing the particular hole used to insert the stopper or stoppers 74 the vertical height of the depending mobile 76 relative to the base 66 and supporting lower surface G may be varied.

Figure 8A:
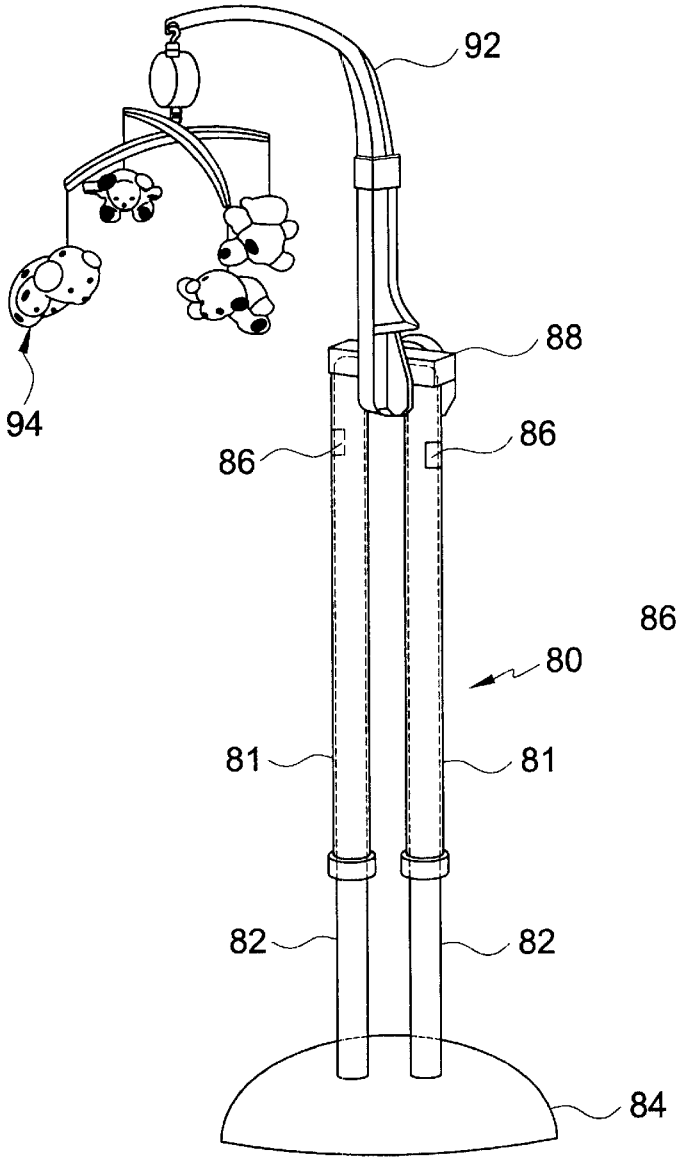
FIG. 8 is a perspective view of another fourth preferred embodiment for the stand showing the mobile holding mechanism enlarged.
Figure 8B:
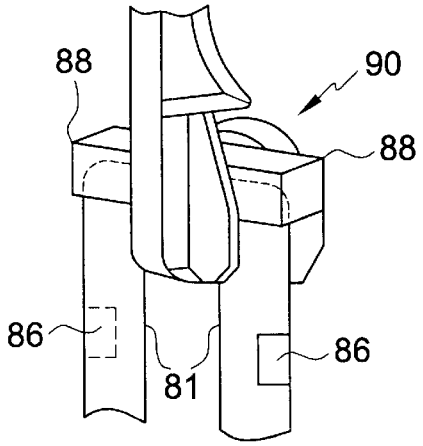

FIG. 8 is a perspective view of another fourth preferred embodiment for the stand showing the mobile holding mechanism enlarged. The basic stand 80 is similar to that shown in FIG. 1. It has two outer parallel legs 81 that are slidably received over the two inner base 84 connected legs 82. The weighed base 84 has an upper domed shaped surface and may either have a hollow fillable interior or may solid base. Slightly different leg retaining members 86 are used to keep the extended outer legs 81 in position relative to the fixed inner legs 82. The members 86 are biased to engage spaced indentations in the surfaces inner legs and are pressed to release them when it is desired to move the outer legs from a given position.

Above the members 86, a solid joining member 88 joins the tops of the legs 81 in position. Mounted on this member 88 (see enlarged circled figure) is a clamp like member 90 which extends under and to the opposite sides of joining member 88. The member 90 forms the supporting lower base for the mobile extension arm 92 which arm in turn supports the depending mobile 94. Clearly, the height of the mobile may be adjusted as desired by the supporting stand.

Most if not all of the disclosed stands can be used for mobiles or virtually any toy that is currently made to attach to a crib. For example, night lights, musical toys, visual toys that have music. All of these items that are made to be attached to a crib can be attached to the described mobile stands and therefore can be used anywhere, not just over a crib. The trend is going towards pack and plays versus cribs, and current playpens and pack and plays do not have bars, and therefore you can not attach mobiles or other toys that attach to cribs to the playpen.

The mobile stands disclosed will allow for toy mobiles and other crib items to be used over a playpen, over a bassinet, next to a high chair, over a changing table, over the changing table in the 3 in 1 pack and play, important to this invention, many of the parts can be constructed of light weight plastic materials, such as the large bases. One plastic material that can be used is ABS (Acrylonitrile-butadiene-styrene) plastic material. The actual material selected for use should be safe, strong, lightweight, and relative inexpensive to manufacture. Some items such as the relating collars and holding clamps would probably best be made of metal to insure sufficient strength. The base supports may be either fillable with a material or sufficiently weighed to ensure they will not topple over when a mobile or other toy is attached to the stand.

Although the preferred embodiments of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A free standing portable support structure for use with a mobile used by an infant comprising:

a lower base for mounting and vertically supporting two vertically disposed support members;

said lower base being hollow and having a fill hole;

fill material insertable into said fill hole into the hollow of the lower base to weigh down the lower base;

two generally parallel vertically disposed support members mounted in said lower base, each of said two vertically disposed members having a lower leg and an upper leg vertically adjustable with respect to the lower leg;

a member joining the upper legs of said two vertically disposed support members;

a mobile support clamped to said member joining the upper legs and extending upwardly and outwardly from the member joining the upper legs; and an infant mobile figure attached to said mobile support and adapted to be mounted over an infant.

2. The free standing portable support structures claimed in claim 1, wherein each of said upper legs of said two vertically disposed support members slidably fit over the lower legs of the two vertically disposed support members; and biasing means for vertically fixing the upper legs of said two vertically disposed support members with respect to the lower legs.

3. A free standing portable support structure for use with a mobile used by an infant comprising:

a lower base for mounting and vertically supporting a vertically disposed support member;

said lower base being hollow and having a fill hole;

fill material insertable into said fill hole into the hollow of the lower base to weigh down the lower base;

a vertically disposed support member mounted in said lower base;

said vertically disposed member having an upper support member and a lower support member mounted in the lower base;

said upper support member being vertically adjustable with respect to the lower support member;

a third member joining the upper support member, said third member extending outwardly from the upper support member;

a mobile support clamped to said third member joining the upper support member; and an infant mobile figure attached to said mobile support and adapted to be mounted over an infant.

* * * * *